US008994356B2

(12) United States Patent
Theoduloz et al.

(10) Patent No.: US 8,994,356 B2
(45) Date of Patent: Mar. 31, 2015

(54) METHOD FOR ADJUSTING A REFERENCE VOLTAGE BASED ON A BAND-GAP CIRCUIT

(75) Inventors: Yves Theoduloz, Yverdon (CH); Richard Stary, Prague 6 (CZ); Petr Drechsler, Jesenice (CZ)

(73) Assignee: EM Microelectronic-Marin SA, Marin (CH)

( * ) Notice: Subject to any disclaimer, the term of this patent is extended or adjusted under 35 U.S.C. 154(b) by 287 days.

(21) Appl. No.: 13/584,125

(22) Filed: Aug. 13, 2012

(65) Prior Publication Data

US 2013/0043859 A1 Feb. 21, 2013

(30) Foreign Application Priority Data

Aug. 16, 2011 (EP) ..... 11177618

(51) Int. Cl.

| | |
|---|---|
| ***G05F 3/16*** | (2006.01) |
| ***G05F 3/20*** | (2006.01) |
| ***G05F 1/10*** | (2006.01) |
| ***G05F 3/02*** | (2006.01) |
| ***G05F 3/30*** | (2006.01) |

(52) U.S. Cl.

CPC ..... *G05F 3/30* (2013.01)
USPC ..... 323/313; 327/539

(58) Field of Classification Search

CPC ..... G05F 3/02; G05F 3/16; G05F 3/20; G05F 3/205; G05F 3/22; G05F 3/222; G05F 3/24; G05F 3/242; G05F 3/26; G05F 3/262; G05F 3/265; G05F 3/267; G05F 3/30; G05F 1/46; G05F 1/462; G05F 1/468; G05F 1/56; H02M 3/07; H02M 3/073; G11C 5/147; G11C 5/08
USPC ..... 323/281, 312–317, 907; 327/512, 513, 327/538–543

See application file for complete search history.

(56) References Cited

U.S. PATENT DOCUMENTS 6,590,372 B1 7/2003 Wiles, Jr.
6,812,684 B1 11/2004 Leifhelm et al.

(Continued)

FOREIGN PATENT DOCUMENTS

WO WO 02/42856 A1 5/2002

OTHER PUBLICATIONS

European Search Report issued Mar. 21, 2012 in corresponding European Application No. 11 17 7618 filed on Aug. 16, 2011 (with an English Translation).

*Primary Examiner* — Timothy J Dole
*Assistant Examiner* — Carlos Rivera-Perez
(74) *Attorney, Agent, or Firm* — Oblon, McClelland, Maier & Neustadt, L.L.P.

(57) ABSTRACT

A method adjusts a reference voltage of an electronic circuit based on a band-gap voltage supplied by a first band-gap stage. The band-gap stage includes in a series arrangement, between two terminals of a voltage supply source, a current source connected to a first branch, which includes a first configurable resistor in series with a first diode, and to a second branch, which includes a second configurable resistor connected to a complementary resistor in series with a second diode. The band-gap voltage is supplied to a connection node between the current source and each branch. The current source is a PMOS transistor controlled by an output voltage of a first operational amplifier of a current control loop. An appropriate binary word for configuring the configurable resistors is determined based on four band-gap voltage values measured at two different temperatures and two resistive values of the resistors configured by the same first binary word and by the same second binary word which is different from the first binary word.

15 Claims, 2 Drawing Sheets

(56) References Cited

U.S. PATENT DOCUMENTS 7,164,259 B1 1/2007 Megaw et al.
2006/0043957 A1 3/2006 Carvalho
2008/0116875 A1 5/2008 Ma
2011/0273227 A1 * 11/2011 Pan et al. ..... 327/539

* cited by examiner

METHOD FOR ADJUSTING A REFERENCE VOLTAGE BASED ON A BAND-GAP CIRCUIT

This application claims priority from European Patent Application No. 11177618.3 filed Aug. 16, 2011, the entire disclosure of which is incorporated herein by reference.

FIELD OF THE INVENTION

The invention concerns a method for adjusting a reference voltage of an electronic circuit provided with a band-gap stage.

The invention also concerns an electronic circuit for implementing this method for adjusting a reference voltage.

BACKGROUND OF THE INVENTION

Making electronic circuits including a band-gap stage to provide a reference voltage is generally well known. This reference voltage must, in principle, be regulated to be independent of temperature.

As shown in FIG. 1, this type of band-gap electronic circuit 1 is formed of a diode, such as a bipolar transistor N1 in a diode arrangement traversed by a continuous current Ic generated by a current source Sc to define a diode voltage $V_{BE}$. Generally, this diode voltage $V_{BE}$ decreases with an increase in temperature, and conversely increases with a decrease in temperature. Current source Sc and the diode-connected bipolar transistor N1 are series-connected between two terminals of a continuous supply voltage.

Since diode voltage $V_{BE}$ varies inversely with temperature variation, there is also provided a generator 2 of a voltage $K \cdot U_T$, wherein voltage $K \cdot U_T$ varies inversely with diode voltage $V_{BE}$. This voltage $K \cdot U_T$ is added in an adder 3 to the diode voltage to supply a reference voltage $V_{REF}$, which is equal to $V_{BE}+K \cdot U_T$. Factor K is thus adapted to obtain a reference voltage $V_{REF}$ which is independent of temperature. To achieve this, $dV_{BE}/dT$ must be equal to $-K \cdot dU_T/dT$. Reference voltage $V_{REF}$, which may be a band-gap voltage, has a value substantially equal to 1.22 volts at 0° C. The thermodynamic voltage $U_T$, which is equal to $k \cdot T/q$, has a value of around 23.5 mV at 0° C., where k is the Boltzmann constant, T is the Kelvin temperature and q is the charge of an electron in absolute value.

Generally, for the type of band-gap electronic circuit shown in FIG. 1, a default value of factor K is set when the electronic circuit is designed in order to have a temperature-independent reference voltage $V_{REF}$. This factor K affects the absolute reference voltage and first order temperature dependence. During adjustment of the absolute value of the reference voltage, the factor K variation also affects temperature stability. Since the method for manufacturing this type of electronic circuit may vary for adjusting the reference voltage, this may result in non-optimum temperature stability. This leads to variation from one electronic circuit to another with a reference voltage that is not entirely temperature-independent, which is a drawback.

US Patent Application No. 2006/0043957 A1, which discloses an electronic circuit of this type, provided with a band-gap stage, may be cited in this regard. This Patent Application discloses a way of adjusting the temperature coefficient. To achieve this, voltage measurements are taken at different temperatures in order to calculate the slope and thus adjust the reference voltage generated. This band-gap stage therefore supplies a precise reference voltage following different temperature coefficient adjustment measurements. However, the adjustment method requires several measuring steps in order to extract the precise reference voltage adjustment parameters, which is a drawback. Moreover, the reference voltage adjustment is highly dependent on variations in the electronic circuit manufacturing parameters, which is another drawback.

SUMMARY OF THE INVENTION

It is thus an object of the invention to overcome the drawbacks of the prior art by providing a method for adjusting a reference voltage based on an electronic circuit provided with a band-gap stage, which is simple to implement. The method easily adjusts the generated reference voltage independently of variations in the manufacturing parameters of said electronic circuit and removes first order temperature dependence.

The invention therefore concerns a method for adjusting a reference voltage of an electronic circuit provided with a band-gap stage, wherein the band-gap stage includes in a series arrangement between two terminals of a supply voltage source, at least one current source, a first configurable resistor and a first diode, the band-gap stage supplies a band-gap voltage, which is defined by the voltage generated by the current passing through the configurable resistor and the diode, the reference voltage being obtained based on the band-gap voltage supplied by the band-gap stage, and wherein the method includes the step consisting in:

- measuring a first band-gap voltage with a first resistor value configured by a first binary word at a first temperature selected within an operating temperature range of the electronic circuit,
- measuring a second band-gap voltage with a second resistor value configured by a second binary word at the first temperature,
- measuring a third band-gap voltage with the first resistor value configured by the first binary word at a second temperature which is different from the first temperature and within the operating temperature range of the electronic circuit,
- measuring a fourth band-gap voltage with the second resistor value configured by the second binary word at the second temperature, and
- determining an appropriate binary word for configuring the configurable resistor based on the four measured band-gap voltage values, so as to obtain a band-gap voltage that is independent of temperature variation.

The invention concerns also a method for adjusting a reference voltage of an electronic circuit, which is provided with a band-gap stage, wherein the band-gap stage includes in a series arrangement between two terminals of a supply voltage source of at least one supply voltage source, at least one current source, a first configurable resistor and a first diode, the band-gap stage supplies a band-gap voltage, which is defined by the voltage generated by the current passing through the configurable resistor and the diode, the reference voltage being obtained based on the band-gap voltage supplied by the band-gap stage, and wherein the method includes the step consisting in:

- measuring a first band-gap voltage with a first resistor value configured by a first binary word at a first temperature selected within an operating temperature range of the electronic circuit,
- measuring a second band-gap voltage with the first resistor value configured by the first binary word at a second temperature which is different from the first temperature and within the operating temperature range of the electronic circuit, measuring a third band-gap voltage with a second resistor value configured by a second binary word at the first temperature, measuring a fourth band-gap voltage with the second resistor value configured by the second binary word at the second temperature, and determining an appropriate binary word for configuring the configurable resistor based on the four measured band-gap voltage values, so as to obtain a band-gap voltage that is independent of temperature variation.

One advantage of the method for adjusting a reference voltage according to the invention lies in the fact that a band-gap voltage is measured at two different temperatures for two resistor values trimmed by two binary words. The appropriate binary calibration word of one or two configurable resistors of the band-gap stage is determined based on four band-gap voltage values to obtain a temperature-independent band-gap voltage.

Another advantage of the reference voltage adjusting method is that the reference voltage level may thus be precisely adjusted in a second step based on the adjusted band-gap voltage. The reference voltage adapted to the desired level is also independent of any temperature variation.

The invention therefore also concerns an electronic circuit provided with a band-gap stage for implementing the reference voltage adjustment method, wherein the reference voltage is obtained based on a band-gap voltage supplied by a first band-gap stage, wherein the first band-gap stage includes in a series arrangement between two terminals of a supply voltage source, a current source connected to a first branch, which includes a first configurable resistor in series with a first diode, and to a second branch, which includes a second configurable resistor connected to a complementary resistor in series with a second diode, the band-gap voltage being supplied to a connection node between the current source and each branch.

BRIEF DESCRIPTION OF THE DRAWINGS

The objects, advantages and features of the reference voltage adjustment method and the electronic circuit for implementing the same will appear more clearly in the following description made with reference to at least one non-limiting embodiment, illustrated by the drawings, in which.

DETAILED DESCRIPTION OF THE INVENTION

In the following description, all those elements of the electronic circuit for implementing the reference voltage adjustment method, which are well known to those skilled in the art in this technical field, will only be described in a simplified manner.

Figure 2:
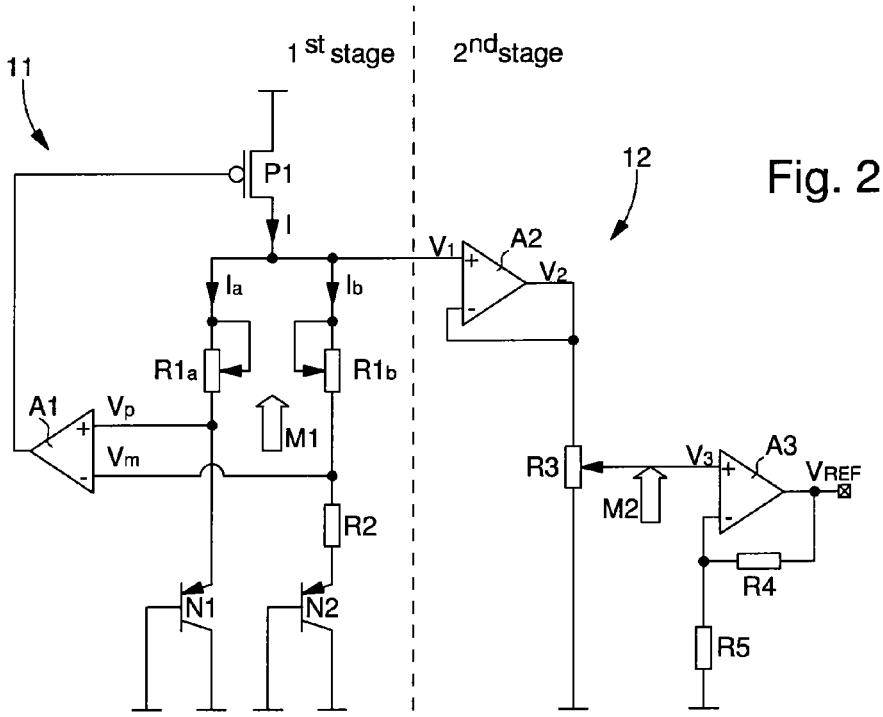
FIG. 2 shows an embodiment of an electronic circuit provided with a band-gap stage for implementing the method for adjusting a temperature-independent reference voltage in accordance with the invention.

FIG. 2 shows an embodiment of the electronic circuit, which includes at least a first band-gap stage 11 for supplying a band-gap voltage V1 and a second stage 12 for adapting the reference voltage $V_{REF}$ based on band-gap voltage V1. In a first step of the adjustment method, band-gap voltage V1 is adjusted to be independent of any temperature variation. In a second step of the adjusting method, reference voltage $V_{REF}$ may be adapted to a desired level for powering other electronic components. However, band-gap voltage V1 may also be used as reference voltage for other electronic components. This reference voltage does not vary with temperature if the band-gap voltage has been properly adjusted in the first stage and in accordance with the adjustment method of the present invention, as explained below.

A simple configuration of the electronic circuit with the first band-gap stage may include at least one current source P1, a resistor R1*a* which can be configured by a binary word M1 and a diode element, such as a diode-connected bipolar transistor N1. The current source, resistor and junction diode are series-connected between two terminals of a supply voltage source which is not shown. Current source P1 is preferably connected to the high potential terminal of the supply voltage source, whereas diode N1 is preferably connected to the low potential terminal of the supply voltage source. Band-gap voltage V1, which may define, in this case, a reference voltage, is thus supplied to the connection node between the current source P1 and the configurable resistor R1*a*. However, this band-gap voltage may also be supplied to the connection node between current source P1 and diode N1, if the configurable resistor R1*a* is directly connected to the low potential terminal of the voltage supply source. This band-gap voltage V1 is thus the addition of the diode voltage of transistor N1 and the voltage generated by the current passing through resistor R1*a*.

Figure 1:
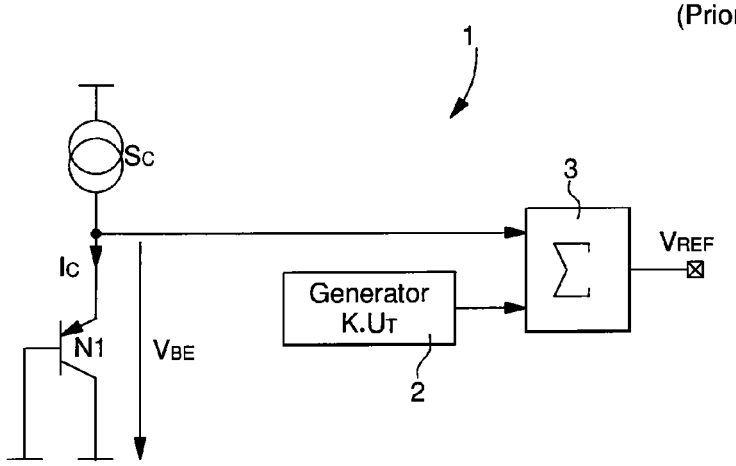
Fig. 1 (Prior art)
FIG. 1, cited above, shows a simplified view of an electronic band-gap circuit of the state of the art.

The electronic circuit is generally formed in a semiconductor substrate, such as silicon Si or gallium arsenide GaAs. With an increase in temperature, the value of resistor R1*a* increases, whereas diode voltage N1 decreases, and the reverse occurs with a decrease in temperature. The binary word M1 must therefore be determined so that the band-gap voltage V1 output by the first stage 11 is independent of temperature variation. As explained below, particularly with reference to FIG. 3, the method for adjusting a reference voltage determines the appropriate binary word M1 for configuring resistor R1*a*. The method for adjusting a reference voltage or band-gap voltage V1 eliminates first order temperature dependence by adapting factor K, as briefly explained with reference to FIG. 1.

According to the adjustment method of the present invention, band-gap voltage V1 must be measured at a first temperature T1 and at a second temperature T2 within a temperature range that allows the electronic circuit to operate. This temperature range may, for example, be between −40° C. and at least 85° C. depending on the technology used for integrating the electronic circuit. For example, a first temperature T1 of 0° C. and a second temperature T2 of 60° C. may be selected, but other temperatures may also be selected for the adjustment method of the invention.

Preferably, the two measuring temperatures T1 and T2 may be selected on either side of a median temperature value within the electronic circuit operating temperature range. This also minimises the second order effects. The two temperatures must also be sufficiently far apart without approaching the limits of the temperature range to avoid amplifying measurement imprecisions.

Band-gap voltage V1 is measured at two temperatures at a first resistor value R1*a* and a second resistor value. Two first band-gap voltage values V1 are advantageously measured at the first temperature T1 for the two resistor values R1*a* configured in succession by the two binary words M1. Next, two second band-gap voltage values V1 are measured at the second temperature T2 for the two resistor values R1*a* configured in succession by the two binary words M1. The four band-gap voltage values may be stored in storage means in a microprocessor unit, which may be integrated in the same integrated circuit as the electronic circuit or simply be connected to the electronic circuit.

The two band-gap voltage values V1 of the two resistor values at first temperature T1 may also be stored in a test file during production. This file may be reused when the two band-gap voltage values are tested at the second temperature T2 for the final calculation of factor K. The production test stores the results of the measurement of the two band-gap voltage values at the first temperature associated with each circuit. In these conditions, it is not necessary for the electronic circuit to have a non-volatile memory.

In a variant of the method, two values of band-gap voltage V1 may be measured with the first resistor value R1*a* configured by a first binary word M1, at the two measuring temperatures T1 and T2. Next, two other band-gap voltage values V1 may also be measured with the second resistor value R1*a* configured by a second binary word M1 at the two temperatures T1 and T2. The four band-gap voltage values V1 may be stored in the storage means of the microprocessor unit.

Based on the four stored band-gap voltage values V1, it is immediately possible to calculate the binary word required for configuring said resistor R1*a*. Once resistor R1*a* is configured by the appropriate binary word M1, the band-gap voltage V1 is independent of any temperature variation. This allows the first order temperature stability to be adjusted. The binary configuration word M1 for the configurable resistors may be a binary word of at least 4 bits, and preferably 7 or more bits. The current I supplied by the current source may also be adapted as a function of the band-gap voltage value to obtain a determined band-gap voltage level V1 that takes account of the value of the configured resistor R1*a*.

It should also be noted that the variation slopes of the band-gap voltage can be determined for the two values of resistor R1*a* configured by the two different binary words M1, to determine the appropriate binary word M1. However, in this case, the equations must take account of the measuring temperature values, which complicates the reference voltage adjustment method. Moreover, the same binary word is always obtained for identical slopes of every measured electronic circuit, which means that advantage cannot be taken of proper temperature adaptation.

Next, in a second step, the reference voltage $V_{REF}$ can be adapted in the second stage 12 of the electronic circuit. This reference voltage $V_{REF}$ can be precisely adjusted to a higher value or a lower value for example around 0.8 volts, or also to an identical value to that of band-gap voltage V1, as explained in more detail below. Since the band-gap voltage adapted in the first stage 11 of the electronic circuit may be different from one circuit to another in the same integrated circuit wafer or in different integrated circuit wafers, the desired reference voltage has to be adapted in the second stage 12.

In a more complete configuration illustrated in FIG. 2, the first band-gap stage 11 is first of all formed of a current source P1, which is made by means of a PMOS transistor P1. The source of PMOS transistor P1 is connected to a high potential terminal of a supply voltage source (not shown), whereas the drain is connected to a first configurable resistor R1*a* and to a second configurable resistor R1*b*. In order to make PMOS transistor P1 conductive, the gate of said PMOS transistor P1 is controlled by an output voltage of a first operational amplifier A1 of a current control loop. Thus a controlled current I is supplied by said PMOS transistor P1 to the first and second configurable resistors R1*a* and R1*b*. A first current $I_a$ passes through first resistor R1*a*, whereas a second current $I_b$ passes through second resistor R1*b*. The band-gap voltage V1 output by first stage 11 is defined at the connection node between PMOS transistor P1 and each configurable resistor R1*a* and R1*b*.

In a first branch, the first resistor R1*a* is connected on one side to the drain of PMOS transistor P1 and on the other side to a first diode, which is preferably a first diode-connected bipolar transistor N1. This first diode-connected transistor N1 is formed of n elementary bipolar transistors. This first bipolar transistor may be a PNP transistor with the base and collector connected to the low potential terminal of the supply voltage source. Thus PMOS transistor P1, first resistor R1*a* and the first diode-connected bipolar transistor N1 are series-connected between the terminals of the voltage supply source.

In a second branch, the second resistor R1*b* is connected on one side to the drain of PMOS transistor P1 and on the other side to a complementary resistor R2, which is then connected to a second diode.

This second diode is preferably a second diode-connected bipolar transistor N2. This second diode-connected transistor N2 is formed of m elementary bipolar transistors. The second bipolar transistor may be a PNP transistor with the base and collector connected to the low potential terminal of the voltage supply source. Thus, PMOS transistor P1, second resistor R1*b*, complementary resistor R2 and the second diode-connected bipolar transistor N2 are series-connected between the terminals of the voltage supply source.

The number m of elementary bipolar transistors of the second branch is higher than the number n of elementary bipolar transistors of the first branch. In an advantageous embodiment of the electronic circuit, the number n of elementary bipolar transistors for diode N1 may be chosen to be equal to 1, whereas the number m of elementary bipolar transistors of diode N2 may be chosen to be equal to 24. This choice results from the good match required with central symmetry when the elementary transistors are placed on the integrated circuit of the electronic circuit. The elementary bipolar transistor of diode N1 is arranged at the centre of the 24 elementary bipolar transistors of diode N2 to give a square-shaped structure.

The two configurable resistors R1*a* and R1*b* may be similar and configured by the same binary word M1 supplied via a configuration bus connected to the microprocessor unit. Each configurable resistor may be formed in series of a base resistor and an array of resistors. The resistors of the array may each be short-circuited by means of a respective switch actuated by a respective bit of binary word M1. The values of one part of the resistors of the array may be weighted by the power of 2 or each have the same value, for example selected between 15 and 20 kOhm. Preferably, each configurable resistor may vary from 1.8 MOhm (base resistor) to 4.03 MOhm. The default value of each configurable resistor, which is adjusted for example to the design, may be set at 2.94 MOhm. The complementary resistor R2 may have a set value on the order of 420 kOhm. Of course, other resistor values may be provided to obtain a band-gap voltage V1 on the order of 1.22 volts at 0° C.

It should be noted that instead of the first and second PNP diode-connected bipolar transistors N1 and N2, it is possible to envisage using first and second NPN diode-connected bipolar transistors N1 and N2. In this case, the emitter of each transistor is connected to the low potential terminal of the voltage supply source, whereas the base and the collector are connected to the first resistor R1*a* for the first resistor and to the complementary resistor R2 for the second transistor.

As mentioned above, current I, which is supplied by the PMOS transistor P1 to resistors R1*a*, R1*b* and R2 and to diodes N1 and N2, is determined in the current control loop. To achieve this, the positive input of the first operational amplifier A1 receives a first comparison voltage value Vp at the connection node between the first configurable resistor R1*a* and the first diode-connected PNP transistor N1. The negative input of the first operational amplifier A1 receives a second comparison voltage value Vm at the connection node between the second configurable resistor R1*b* and the complementary resistor R2. The output of this first operational amplifier A1 controls the gate of the PMOS transistor P1 so as to control current $I_a$ passing through the first configurable resistor R1*a* and current $I_b$ passing through the second configurable resistor R1*b*.

The first stage 11, which supplies band-gap voltage V1, thus adjusts the first order temperature stability. Conversely, second stage 12 enables the desired reference voltage value $V_{REF}$ to be adjusted without altering temperature stability, via a simple offset adjustment, as explained in more detail below.

The value of band-gap voltage V1, which is output by first stage 11, is defined by the following equation:

$$V1=Vp+R1a\cdot In(m/n)\cdot U_T/R2$$

where Vp is the diode voltage $V_{BE}$ of the first diode-connected PNP transistor N1, which is formed of n elementary bipolar transistors. Factor K for adjusting the first order temperature stability is thus R1*a*·In(m/n)/R2.

It is therefore easy to calculate factor K in order to obtain a band-gap voltage V1 which is temperature stable by applying the equation K=(V1−Vp)/$U_T$. It is clear that this result may vary from one electronic circuit to another with variations in the manufacturing method. Configurable resistor R1*a* and configurable resistor R1*b* both therefore allow adjustment of factor K.

Figure 3:
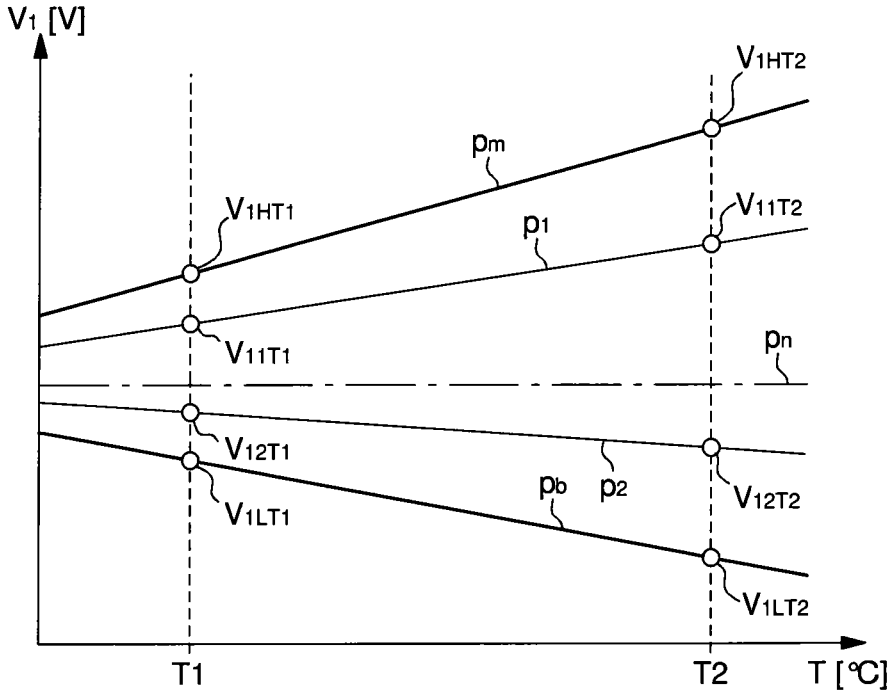
FIG. 3 shows a graph representing the variation with temperature of the voltage supplied by the electronic circuit band-gap stage with respect to implementation of the reference voltage adjustment method of the invention.

As shown in FIG. 3, if the value of these configurable resistors varies from a minimum value to a maximum value by the i-bit binary configuration word M1, the variation with temperature of band-gap voltage V1 is represented by the straight lines $p_b$ and $p_m$. For a maximum value of the configurable resistors, a first band-gap voltage value $V_{1HT1}$ can be measured at a first temperature T1, and a second band-gap voltage value $V_{1HT2}$ at a second temperature T2. The slope of line $p_m$ for a maximum configurable resistor value is a positive slope, which means that the band-gap voltage increases with a temperature increase. For a minimum value of the configurable resistors, a first band-gap voltage value $V_{1LT1}$ can be measured at a first temperature T1, and a second band-gap voltage value $V_{1LT2}$ at a second temperature T2. The slope of line $p_b$ for a minimum configurable resistor value is a negative slope, which means that the band-gap voltage decreases with a temperature increase.

For the factor K adjustment it is therefore simply necessary to measure two band-gap voltages V1 values at two different temperatures. This enables the appropriate binary word M1 for configuring resistors R1*a* and R1*b* of FIG. 2 to be determined, to obtain a temperature-independent band-gap value V1. The temperature-independent band-gap voltage V1 is represented by the dotted line $p_n$ in FIG. 3. This line $p_n$ is parallel to the temperature axis x.

In a practical case of determining the appropriate binary word, the configurable resistors are configured between the minimum and maximum values. They are configured at a first resistive value by a first binary word and at a second resistive value by a second binary word. The first resistive value may be, for example, higher than the second resistive value. The first line $p_1$ relating to the first resistive value is shown with a positive slope, whereas the second line $p_2$ is shown with a negative slope. However, it is also entirely possible for both slopes to be positive or for both slopes to be negative for determining the appropriate binary word. It is, however, imperative that the electronic circuit is devised to have a positive slope with a maximum configurable resistor value and a negative slope with a minimum configurable resistor value. This is necessary to determine the appropriate zero temperature variation binary word of the band-gap voltage.

A first band-gap voltage value $V_{11T1}$ can be measured at first temperature T1 with the first resistive value of the configurable resistors. A first band-gap voltage value $V_{12T1}$ can be measured at first temperature T1 with the second resistive value of the configurable resistors. A second band-gap voltage value $V_{11T2}$ can be measured at the second temperature T2 with the first resistive value of the configurable resistors. Finally, a second band-gap voltage value $V_{12T2}$ can be measured at the second temperature T2 with the second resistive value of the configurable resistors. The four band-gap voltage values are stored in storage means of the microprocessor unit for determining the appropriate binary word.

The appropriate i-bit binary word M1 for configuring resistors R1*a* and R1*b* is thus given by the following equation:

$$M1[i-1:0]=(2^i-1)\cdot(V_{12T1}-V_{12T2})/(V_{11T2}-V_{12T2}-V_{11T1}+V_{12T1})$$

It should be noted that the aforementioned formula relies on very good differential non-linearity (DNL) and very good integral non-linearity (INL). Between the values $V_{1HT1}$ and $V_{1LT1}$, and between values $V_{1HT2}$ and $V_{1LT2}$, all the adjustment steps (LSB) must, if possible, be equal to each other. If the function V1=f(M1) is not linear, the above formula must, in principle, be adapted to this non-linearity.

Differential non-linearity focuses on the adjustment steps. This differential non-linearity is the relation between each adjustment step and the theoretical step. For an adjustment ranging from 0 to 15 (16 steps), which is encoded on 4 bits, there is a theoretical step of 1. To characterize this means, the value of each step can be measured and compared to the theoretical result. For a theoretical step (LSB=1) of the series 0, 1, 2 up to 15, a series from 0, 1.1, 1.9, 3.2 up to 15 is measured for example. The differential non-linearity is calculated for each step, and gives DNL(0)=0, DNL(1)=(1.1−0)/LSB−1=0.1, DNL(2)=(1.9−1.1)/LSB−1=0.2, DNL(3)=(3.2−1.9)/LSB−1=0.3 and so on. Thus the differential non-linearity (DNL) of this system is the maximum absolute value between all the steps DNL(i) which are defined by the formula (f(i)−f(i−1))/LSB−1.

The integral non-linearity (INL) represents the accumulation of the differential non-linearity (DNL). This integral non-linearity shows the deviation of the adjustment function relative to the theoretical curve. For each step, this gives INL(0)=DNL(0)=0, INL(1)=DNL(0)+DNL(1)=0.1, INL(2)=DNL(0)+DNL(1)+DNL(2)=−0.1, INL(3)=DNL(0)+DNL(1)+DNL(2)+DNL(3)=0.2 and so on. The integral non-linearity (INL) of this system is the maximum absolute value between all the INL(i).

If the differential non-linearity of this type of system is poor, this means that there is typically a broad deviation in the distribution of the steps around the theoretical value. Poor integral non-linearity means that the adjustment curve is not far from the theoretical curve. On portions of the curve, the mean value of the steps is not equal to the theoretical value of the steps. This also means that on this portion, the mean value of the DNL(i) is not equal to 0.

For a DNL smaller than 0.5, this means that the system is monotonous and of high quality. For a DNL larger than 0.5, each step has to be analysed. For an INL smaller than 0.5, this means that the adjustment function never moves away from the theoretical curve by more than 0.5 LSB. This is a very good result.

For determination of the electronic circuit reference voltage, the factor K adjustment range must always be broad enough to obtain a variation slope for band-gap voltage V1 which is always positive for Kmax and always negative for Kmin. The binary configuration word M1 is thus minimum for Kmin and maximum for Kmax. With a minimum value Kmin, each configurable resistor R1*a* and R1*b* may have a value of 1.8 MOhm. However, with a maximum value Kmax, each configurable resistor R1*a* and R1*b* may have a value of 4.03 MOhm.

It should be noted that an optimum factor K does not necessarily give an optimum absolute value result. This is due in particular to variations in the electronic circuit manufacturing method.

With the method for adjusting the reference voltage and particularly the band-gap voltage according to the invention, it is possible to perform an immediate calculation with two pairs of band-gap voltage values to be measured. Two first band-gap voltage values are measured with the resistors configured with two different binary words at a first temperature T1. The two measurements are taken in very close time periods and with a stable first temperature T1. The junction temperature of diodes N1, N2 therefore does not have time to change. Next, two second band-gap voltage values are measured with the resistors configured by the two binary words at a second temperature T2. Again, the two measurements are performed in very close time periods and with a stable second temperature T2. With this manner of determining the four band-gap voltage values, each absolute temperature value does not need to be selected very precisely.

As previously indicated, it is also possible to envisage calculating the temperature variation slopes of band-gap voltage V1. However, this measuring method requires absolute temperature precision for the first and second measuring temperatures. This measuring method is difficult to put into practice in producing electronic circuits. Thus this method does not offer any great advantage for determining the appropriate binary word in order to provide a temperature-independent band-gap voltage.

Set slopes may also be calculated. This only makes sense if it is not possible to store the measurement results in a file or non-volatile memory. The slope calculation takes place during the design characterization phase and is then set for all the integrated circuits according to the characterization.

The absolute value of the reference voltage $V_{REF}$ output by the electronic circuit is adjusted by the second stage 12. In this second stage, a second operational amplifier A2 is arranged as a voltage follower to input band-gap voltage V1 from first stage 11. This voltage follower avoids affecting the adaptation of band-gap voltage V1 in first stage 11. A third configurable resistor R3 is provided for lowering the voltage before the amplification unit. This third resistor R3 is connected between the voltage follower output A2 and the low potential terminal of the supply voltage source. The third resistor R3 includes a low part and a high part, which may be configured by means of a second binary adaptation word M2 supplied via an offset bus. This binary word may also be an at least 4-bit binary word, preferably of 7 or more bits. The low part of the third resistor R3 may have a value equal to 1.66 MOhm, whereas the high part may be configured by the binary word to vary from 0 to 720 kOhm.

The amplification unit includes a third operational amplifier A3, the positive input of which is connected to an intermediate configured part of third resistor R3. This gain of this amplification unit is fixed by fourth and fifth resistors R4 and R5. The fourth resistor R4 is connected between the negative input and the output of the third operational amplifier A3. This fourth resistor may be selected with a value of 862 kOhm. The fifth resistor R5 is connected between the negative input of the third operational amplifier and the low potential terminal of the supply voltage source. This fifth resistor R5 may be selected with a value of 1.57 MOhm. According to this electronic circuit configuration, no voltage is defined as negative. Thus the third amplifier A3 must be connected with a positive gain.

In a variant of the second stage 12 of the electronic circuit, the third operational amplifier A3 may be arranged as a voltage follower without the fourth and fifth resistors. The high part of the third resistor R3 may be adjusted for example to the design at a value of 363 kOhm.

Since band-gap voltage V1 may have a higher value than the desired reference value $V_{REF}$, the overall gain of the second stage must be smaller than 1. Band-gap voltage V1 may be on the order of 1.22 volts, whereas reference voltage $V_{REF}$ may be set at 0.8 volts. To achieve this, band-gap voltage V1 is decreased by the resistive divider formed by the third configurable resistor R3 prior to entering the final amplification unit with the third amplifier A3 of the second stage.

The method for adjusting the reference voltage in second stage 12 may be achieved in several ways depending on the design selected for the second stage. If the differential and integral linearities of the adjustment assembly of the second stage are good (<LSB), the reference voltage can be adjusted in a simple manner. A minimum value and a maximum value can be measured. Next, the binary adjustment word M2 can be calculated, so that it is proportional to the difference between the two measurements min and max, and the desired target value. If only the differential linearity is good, the reference voltage can be adjusted by using a dichotomy method. However, if linearity is not guaranteed, a refined search must be carried out after the dichotomy method has been performed. For all the possibilities chosen for adjusting reference voltage $V_{REF}$ in second stage 12, the binary adjustment word M2 has to be determined to configure the third resistor R3 so as to obtain the desired target value. This binary adjustment word M2 may of course be different from one electronic circuit to another electronic circuit, given that the stabilised band-gap voltage V1 output by the first stage may be different from one circuit to another.

From the description that has just been given, several variants of the method for adjusting the reference voltage of an electronic circuit can be devised by those skilled in the art without departing from the scope of the invention defined by the claims. The current source may be connected to the low potential terminal of the supply voltage source, whereas the series arrangement of the junction diode with the configurable resistor of the first band-gap stage may be connected to the high potential terminal of the supply voltage source. The first and second configurable resistors of the first band-gap stage of the electronic circuit can each be configured separately at a different resistive value.

What is claimed is:

1. A method for adjusting a reference voltage of an electronic circuit, which is provided with a first band-gap stage, wherein the first band-gap stage includes in a series arrangement between two terminals of a supply voltage source, at least one current source, a first configurable resistor and a first diode, the first band-gap stage supplies a band-gap voltage, which is defined by a voltage generated by a current passing through the first configurable resistor and the first diode, the reference voltage being obtained based on the band-gap voltage supplied by the first band-gap stage, the method comprising:

measuring a first band-gap voltage with a first resistive value configured by a first binary word at a first temperature selected within an operating temperature range of the electronic circuit, measuring a second band-gap voltage with a second resistive value configured by a second binary word at the first temperature, measuring a third band-gap voltage with the first resistive value configured by the first binary word at a second temperature,. which is different from the first temperature,. and which is within the operating temperature range of the electronic circuit, measuring a fourth band-gap voltage with the second resistive value configured by the second binary word at the second temperature, and determining an appropriate binary word for configuring the first configurable resistor based on the first through fourth measured band-gap voltages, so as to obtain a band-gap voltage that is independent of temperature variation, wherein the appropriate binary word for configuring the first configurable resistor is determined based on the i-bit binary word formula:

$$M1[i-1:0]=(2^i-1)\cdot(V_{12T1}-V_{12T2})/(V_{11T2}-V_{12T2}-V_{11T1}+V_{12T1}),$$

where $V_{11T1}$ is the band-gap voltage measured at the first resistive value of the first configurable resistor and at the first temperature, $V_{11T2}$ in is the band-gap voltage measured at the first resistive value of the first configurable resistor and at the second temperature, $V_{12T1}$ is the band-gap voltage measured at the second resistive value of the first configurable resistor and at the first temperature, and $V_{12T2}$ is the band-gap voltage measured at the second resistive value of the first configurable resistor and at the second temperature.

2. A method for adjusting a reference voltage of an electronic circuit, which is provided with a first band-gap stage, wherein the first band-gap stage includes in a series arrangement between two terminals of a supply voltage source of at least one supply voltage source, at least one current source, a first configurable resistor and a first diode, the first band-gap stage supplies a band-gap voltage, which is defined by a voltage generated by a current passing through the first configurable resistor and the first diode, the reference voltage being obtained based on the band-gap voltage supplied by the first band-gap stage, the method comprising:

measuring a first band-gap voltage with a first resistive value configured by a first binary word at a first temperature selected within an operating temperature range of the electronic circuit, measuring a second band-gap voltage with the first resistive value configured by the first binary word at a second temperature, which is different from the first temperature, and which is within the operating temperature range of the electronic circuit, measuring a third band-gap voltage with a second resistive value configured by a second binary word at the first temperature, measuring a fourth band-gap voltage with the second resistive value configured by the second binary word at the second temperature, and determining an appropriate binary word for configuring the first configurable resistor based on the first through fourth measured band-gap voltages, so as to obtain a band-gap voltage that is independent of temperature variation, wherein the appropriate binary word for configuring the first configurable resistor is determined based on the i-bit binary word formula:

$$M1[i-1:0]=(2^i-1)\cdot(V_{12T1}-V_{12T2})/(V_{11T2}-V_{12T2}-V_{11T1}+V_{12T1}),$$

where $V_{11T1}$ is the band-gap voltage measured at the first resistive value of the first configurable resistor and at the first temperature, $V_{11T2}$ is the band-gap voltage measured at the first resistive value of the first configurable resistor and at the second temperature, $V_{12T1}$ is the band-gap voltage measured at the second resistive value of the first configurable resistor and at the first temperature, and $V_{12T2}$ is the band-gap voltage measured at the second resistive value of the first configurable resistor and at the second temperature.

3. The method according to any one of claims 1 and 2, wherein respective voltage values associated with the first, second, third and fourth measured band-gap voltages are stored in succession in storage means of a microprocessor unit.

4. The method according to any one of claims 1 and 2, wherein the first temperature and the second temperature are selected to be either side of a median temperature of the operating temperature range of the electronic circuit.

5. The method according to any one of claims 1 and 2, wherein the electronic circuit includes a second band-gap stage for adapting a level of the reference voltage based on the band-gap voltage, said second band-gap stage including a second operational amplifier arranged as a voltage follower to input the band-gap voltage from the first band-gap stage, a third configurable resistor, which is configurable by the second binary word being connected between an output of the second operational amplifier and a low potential terminal of the supply voltage source, and an amplification unit connected to an intermediate configured part of the third configurable resistor to output the adapted reference voltage, and wherein the reference voltage is adapted after the band-gap voltage has been adapted in the first band-gap stage, by configuring the third configurable resistor by the second binary word using a dichotomy method to determine a second appropriate binary word for configuring the third configurable resistor.

6. An electronic circuit configured to implement the method for adjusting a reference voltage according to any one of claims 1 and 2, wherein the reference voltage is obtained based on a band-gap voltage supplied by the first band-gap stage of the electronic circuit, and wherein the first band-gap stage includes in the series arrangement between the two terminals of the supply voltage source, the at least one current source connected to a first branch, which includes the first configurable resistor in series with the first diode, and to a second branch, which includes a second configurable resistor connected to a complementary resistor in series with a second diode, the band-gap voltage being supplied to a first connection node between the at least one current source and each said branch.

7. The electronic circuit according to claim 6, wherein the at least one current source is formed of a MOS transistor, a gate of which is controlled by an output voltage of a first operational amplifier of a current control loop in the MOS transistor, wherein a positive input of the first operational amplifier is connected to a second connection node between the first configurable resistor and the first diode to receive a first comparison voltage, and wherein a negative input of the first operational amplifier is connected to a third connection node between the second configurable resistor and the complementary resistor to receive a second comparison voltage.

8. The electronic circuit according to claim 6, wherein each of the first and the second configurable resistors is configured by a respective binary word.

9. The electronic circuit according to claim 8, wherein the first and second configurable resistors are configured by the same binary word.

10. The electronic circuit according to claim 6, wherein the first diode is a first diode-connected bipolar transistor, and wherein the second diode is a second diode-connected bipolar transistor.

11. The electronic circuit according to claim 10, wherein each of the first and the second diode-connected bipolar transistors is a PNP transistor.

12. The electronic circuit according to claim 10, wherein the first diode-connected bipolar transistor is formed of n elementary bipolar transistors, wherein the second diode-connected bipolar transistor is formed of m elementary bipolar transistors, and wherein the integer number m is greater than the integer number n, which has a value of at least 1.

13. The electronic circuit according to claim 12, wherein the electronic circuit is an integrated circuit, wherein the first diode-connected bipolar transistor includes an elementary bipolar transistor, and wherein the second diode-connected bipolar transistor includes 24 elementary bipolar transistors, which are made around the elementary bipolar transistor of the first diode-connected bipolar transistor so as to form a square-shaped structure.

14. The electronic circuit according to claim 6, further comprising a second band-gap stage for adapting a level of the reference voltage based on the band-gap voltage, wherein the second band-gap stage includes a second operational amplifier arranged as a voltage follower to input the band-gap voltage from the first band-gap stage, a third configurable resistor which is configurable by the second binary word, being connected between an output of the second operational amplifier and a low potential terminal of the supply voltage source, and an amplification unit connected to an intermediate configured part of the third configurable resistor to output the adapted reference voltage.

15. The electronic circuit according to claim 14, wherein the amplification unit includes:

a third operational amplifier, a positive input of which is connected to an intermediate configured part of the third configurable resistor, a fourth resistor connected between a negative input and an output of the third operational amplifier, and a fifth resistor connected between the negative input of the third operational amplifier and a low potential terminal of the supply voltage source, wherein the fourth and fifth resistors fix an amplification gain of the third operational amplifier.

* * * * *